US008096430B2

(12) United States Patent
Lim

(10) Patent No.: US 8,096,430 B2
(45) Date of Patent: Jan. 17, 2012

(54) STORAGE RACK

(75) Inventor: Gary M. Lim, Palos Verdes Peninsula, CA (US)

(73) Assignee: Seville Classics Inc., Torrance, CA (US)

( * ) Notice: Subject to any disclaimer, the term of this patent is extended or adjusted under 35 U.S.C. 154(b) by 363 days.

(21) Appl. No.: 11/515,592

(22) Filed: Sep. 5, 2006

(65) Prior Publication Data

US 2007/0114198 A1 May 24, 2007

(51) Int. Cl.
*E06C 1/00* (2006.01)

(52) U.S. Cl. ..... 211/195; 211/41.6; 211/41.5; 211/200; 217/46

(58) Field of Classification Search ..... 211/41.3, 211/41.14, 41.15, 40, 41.6, 41.5, 195, 74, 211/201, 45, 85, 41.18; 108/111, 59, 153; 206/784; 220/4.34, 4.33, 4.28, 6, 693; 217/8, 217/13, 14, 15, 16, 46, 60 E
See application file for complete search history.

(56) References Cited

U.S. PATENT DOCUMENTS 222,542 A * 12/1879 Stearns ..... 211/200
253,461 A * 2/1882 Wold ..... 211/41.6
638,417 A * 12/1899 Miller ..... 211/200
1,573,844 A * 2/1926 Marvin ..... 211/195
1,578,248 A * 3/1926 Ackerman ..... 190/12 R
2,305,629 A * 12/1942 Magnuson ..... 108/29
2,516,088 A * 7/1950 Einhorn ..... 211/41.5
2,958,424 A * 11/1960 Bigatti ..... 211/41.5
3,113,400 A * 12/1963 Emond ..... 47/45
3,252,434 A * 5/1966 Young, Jr. ..... 108/181
3,349,924 A * 10/1967 Maurer et al. ..... 211/41.1
3,559,339 A * 2/1971 Worley ..... 47/45
3,722,431 A * 3/1973 Howard ..... 108/157.13
4,285,163 A * 8/1981 Booker, Jr. ..... 47/45
4,297,795 A * 11/1981 Licari ..... 34/239
4,828,123 A * 5/1989 Basore ..... 211/202
5,169,009 A * 12/1992 Bomze ..... 211/74
5,217,125 A * 6/1993 Swanson ..... 211/195
5,351,843 A * 10/1994 Wichman et al. ..... 211/195
5,452,811 A * 9/1995 Taravella et al. ..... 211/186
5,580,025 A * 12/1996 Cross ..... 248/507
5,647,487 A * 7/1997 Reinhard ..... 211/40
5,865,320 A * 2/1999 Hamada ..... 211/40
5,924,577 A * 7/1999 Gessert ..... 211/41.1

(Continued)

FOREIGN PATENT DOCUMENTS

EP 1199025 A1 * 4/2002

OTHER PUBLICATIONS

Oct./Nov. 2008, p. 44, Westerninteriors.com; L.A.'s Waterworks ad.

*Primary Examiner* — Katherine Mitchell
*Assistant Examiner* — Candace L Bradford
(74) *Attorney, Agent, or Firm* — Raymond Sun

(57) ABSTRACT

A rack for holding articles includes a plurality of sets of vertical battens, a plurality of sets of horizontal battens that are clamped together with the plurality of sets of vertical battens, a long connecting screw piece that extends through each set of horizontal and vertical battens, and a supplementary connecting screw that connects the front horizontal batten and the front vertical batten. The screw piece defines a pivot axis for folding the battens.

1 Claim, 7 Drawing Sheets

U.S. PATENT DOCUMENTS 5,988,405 A * 11/1999 Weisenburger ..... 211/40
6,017,107 A * 1/2000 Elliott et al. ..... 312/265
6,283,314 B1 * 9/2001 Loguercio ..... 211/200
6,305,764 B1 * 10/2001 Kortman et al. ..... 312/3
6,394,292 B1 * 5/2002 Sabounjian ..... 211/202
6,427,858 B2 * 8/2002 Sabounjian ..... 211/202
6,938,807 B2 * 9/2005 Victor ..... 224/497
6,970,143 B2 * 11/2005 Allen et al. ..... 343/880
7,500,574 B1 * 3/2009 Miller et al. ..... 211/106
2005/0206579 A1 * 9/2005 Allen et al. ..... 343/915
2006/0254992 A1 * 11/2006 Lim ..... 211/41.9
2007/0175847 A1 * 8/2007 Prest ..... 211/195
2008/0283480 A1 * 11/2008 Segall et al. ..... 211/41.6
2009/0184068 A1 * 7/2009 Kin ..... 211/45

* cited by examiner

STORAGE RACK

BACKGROUND OF THE INVENTION

1. Field of the Invention

The present invention relates to an article-holding rack for placing common household articles, and in particular, to a rack for holding articles.

2. Description of the Prior Art

Article-holding racks are used by people in their daily lives to hold common household articles such as towels, clothes, shoes, etc. Many of these racks can be folded or dis-assembled to reduce that overall size and profile for storage and transportation. Unfortunately, many of these conventional racks are still difficult to fold, or assemble and disassemble, so that storage and transport can be inconvenient.

SUMMARY OF THE INVENTION

It is an object of the present invention to provide a rack for holding articles.

It is another object of the present invention to provide a rack that is easy to deploy and to store.

The present invention provides a rack that includes a plurality of sets of vertical battens, a plurality of sets of horizontal battens that are clamped together with the plurality of sets of vertical battens, a long connecting screw piece that extends through each set of horizontal and vertical battens, and a supplementary connecting screw that connects the front horizontal batten and the front vertical batten. The screw piece defines a pivot axis for folding the battens.

DETAILED DESCRIPTION OF THE PREFERRED EMBODIMENTS

Figure 1:
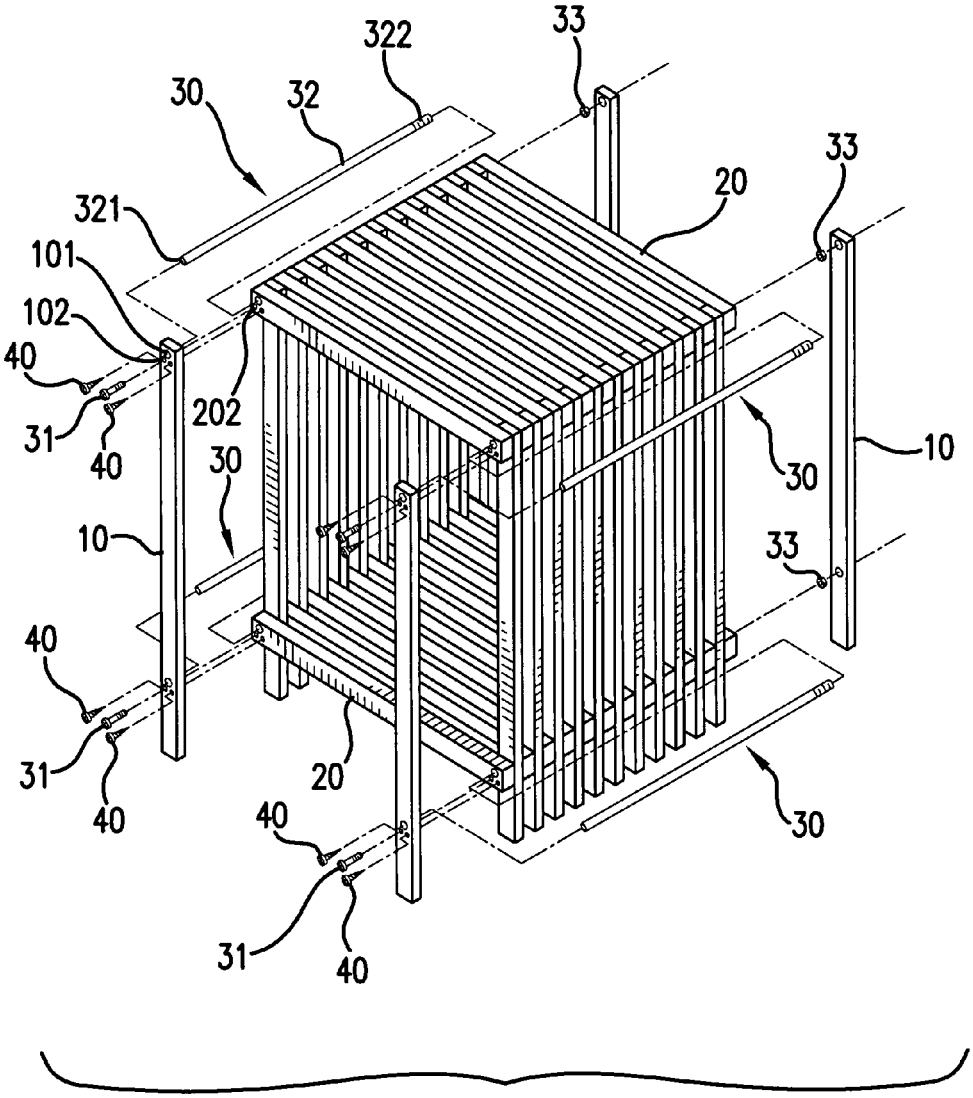
FIG. 1 is an exploded perspective view of a rack according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1-4 illustrate a rack according to one embodiment of the present invention. The rack can be a wooden or a plastic rack. The rack has two sets of a plurality of vertical battens 10 and two sets of a plurality of horizontal battens 20 that are clamped together. Each pair of horizontal battens 20 is separated from an adjacent pair of horizontal battens 20 by a pair of vertical battens 10, and each pair of vertical battens 10 is separated from an adjacent pair of vertical battens 10 by a pair of horizontal battens 20. The intersections of the vertical battens 10 and horizontal battens 20 are each in a tandem connection, with each connection using a novel long connecting screw piece 30. In addition, two supplementary connecting screws 40 are furnished at each of the intersections of the vertical battens 10 in the front and the rear of the rack with the front and rear horizontal battens 20, with each supplementary connecting screw 40 passing through a connecting hole 102 furnished on a front or rear vertical batten 10 and fitting into a screw hole 202 furnished on the corresponding front or rear horizontal batten 20. The screw piece 30 and the screws 40 may be arranged to form a regular triangular shape, with the screw piece 30 positioned at the top corner of a regular triangle and the two screws 40 positioned at the two lower corners of the regular triangle.

The present invention provides a novel screw piece 30. In this regard, a long and thin screw is difficult to produce. Also, since the rack can have a wide length, the strength of the overall structure of the rack will be poor if a single screw is utilized to connect each vertical batten 10 to only the front and rear horizontal battens 20. Accordingly, each connecting screw piece 30 of the present invention includes a screw 31, a connecting rod 32 and a screw hat 33. The front end of the rod 32 is molded with a threaded screw hole 321 that is adapted to threadably receive the screw 31, and the rear end of the rod 32 is molded with threads 322 that are adapted to be threadably received into the screw hat 33. The screw 31 is adapted to pass through the vertical batten 10 at the front of the rack to engage the screw hole 321. The screw hat 33 is imbedded in the vertical batten 10 at the rear of the rack and is adapted to receive the threads 322. The connecting rod 32 is adapted to pass through all the vertical battens 10 and horizontal battens 20 (except for the front battens) between the front and the rear of the rack. With this arrangement, the 10 screw 31 fits into the screw hole 321 at the front end of connecting rod 32 when it passes through a connecting hole 101 furnished on the vertical batten 10 at the front of the rack.

Figure 2:
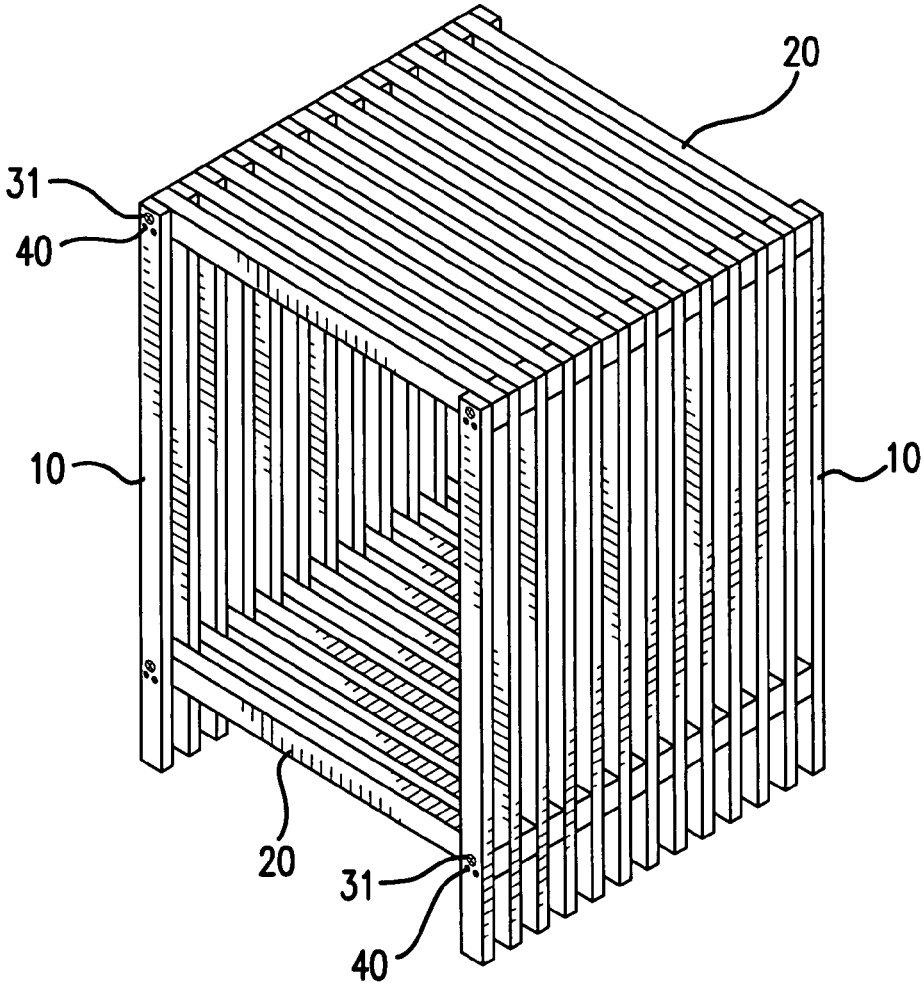
FIG. 2 is an assembled perspective view of the rack of FIG. 1.
Figure 3:
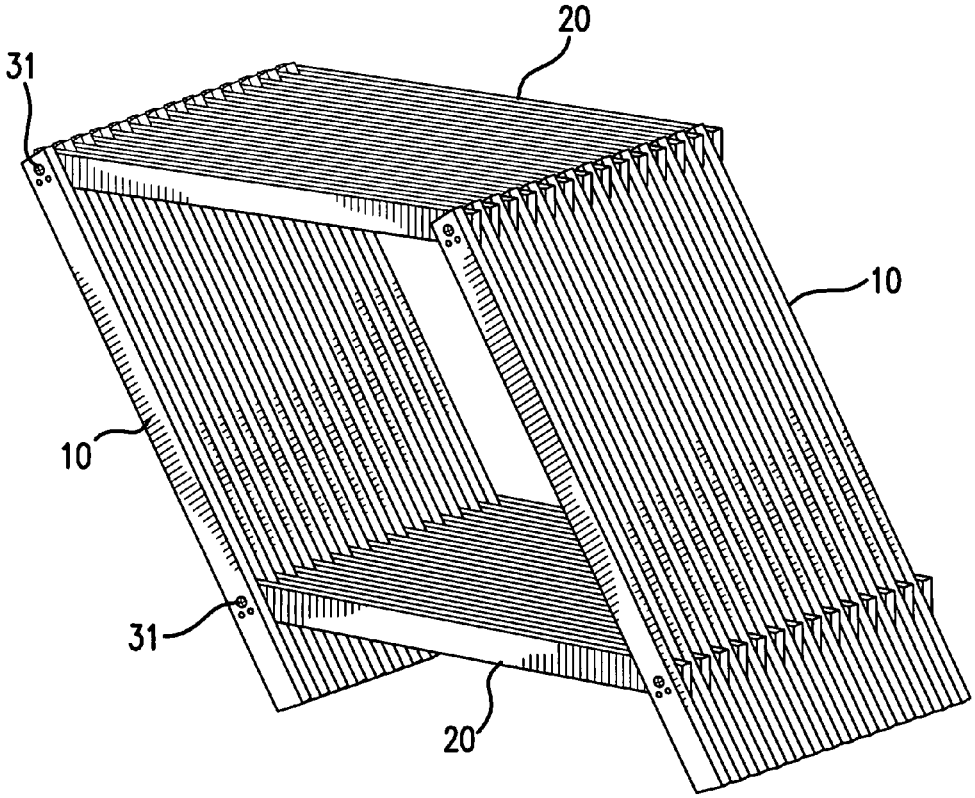
FIG. 3 is a perspective view of the rack of FIG. 2 shown with the rack being partly folded.
Figure 4:
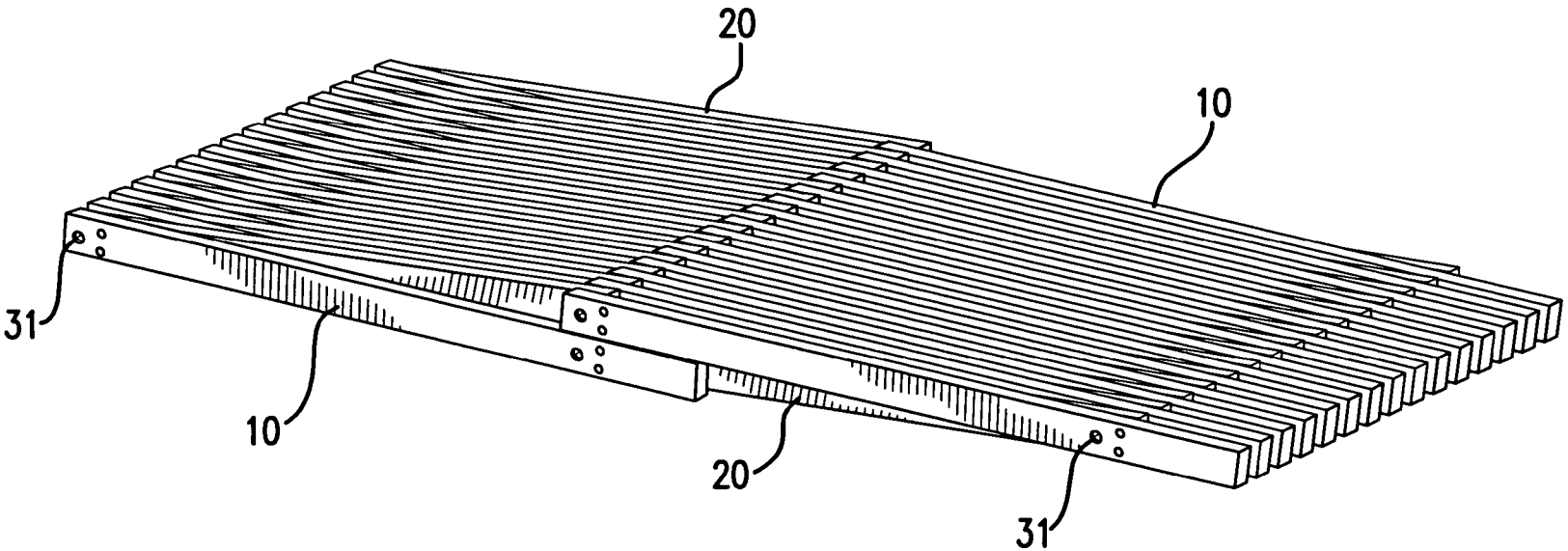
FIG. 4 is a perspective view of the rack of FIG. 2 shown with the rack being completely folded.

FIGS. 3 and 4 illustrate how the rack can be folded for storage. First, the short supplementary connecting screws 40 are removed, and the rack is then folded in the manner shown in FIG. 3 with the screw pieces 30 functioning as pivot axes. Further folding and pivoting from the orientation shown in FIG. 3 will cause the plurality of battens 10 and 20 to assume a flat diamond shape (as shown in FIG. 4) for extremely convenient transport and storage. To deploy the rack, the battens 10 and 20 are pivoted and folded in the reverse direction from FIG. 4 to FIG. 3, and then to assume the orientation of FIG. 2. The short supplementary connecting screws 40 are then installed through the connecting hole 102 furnished on the front or rear vertical batten 10 and the screw hole 202 furnished on the corresponding front or rear horizontal batten 20. Thus, the short supplementary connecting screws 40 function as locking members or screws that secure the battens 10, 20 in the deployed position shown in FIG. 2, while the screw pieces 30 function as pivot axes for the battens 10, 20.

Figure 5:
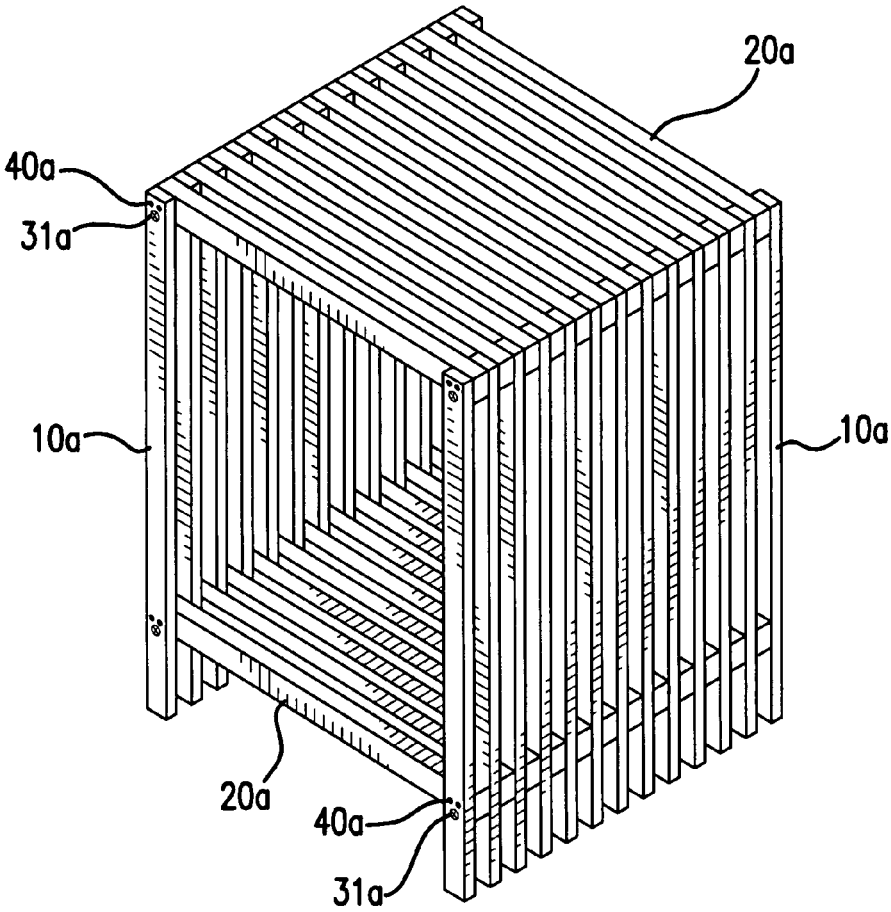
FIG. 5 is a perspective view of a rack according to another embodiment of the present invention.

FIG. 5 illustrates another embodiment of a rack, which is identical to the rack in FIGS. 1 and 2, except that the screw piece 30*a* and the screws 40*a* may be arranged to form an inverted triangular shape, with the screw piece 30*a* positioned at the bottom corner of the inverted triangle and the two screws 40*a* positioned at the two upper corners of the inverted triangle. The same numerals are used to designate the same elements in FIGS. 1-5 except that an "a" has been added to the designations in FIG. 5.

Alternatively, the screws 40 and the screw piece 30 can be arranged in any combination of regular and inverted triangles. For example, the upper ends of the rack can be provided with screws 40 and a screw piece 30 arranged in the configuration of a regular triangle, and the lower ends of the rack can be provided with screws 40 and a screw piece 30 arranged in the configuration of an inverted triangle. Or the lower ends of the rack can be provided with screws 40 and a screw piece 30 arranged in the configuration of a regular triangle, and the upper ends of the rack can be provided with screws 40 and a screw piece 30 arranged in the configuration of an inverted triangle.

Figure 6:
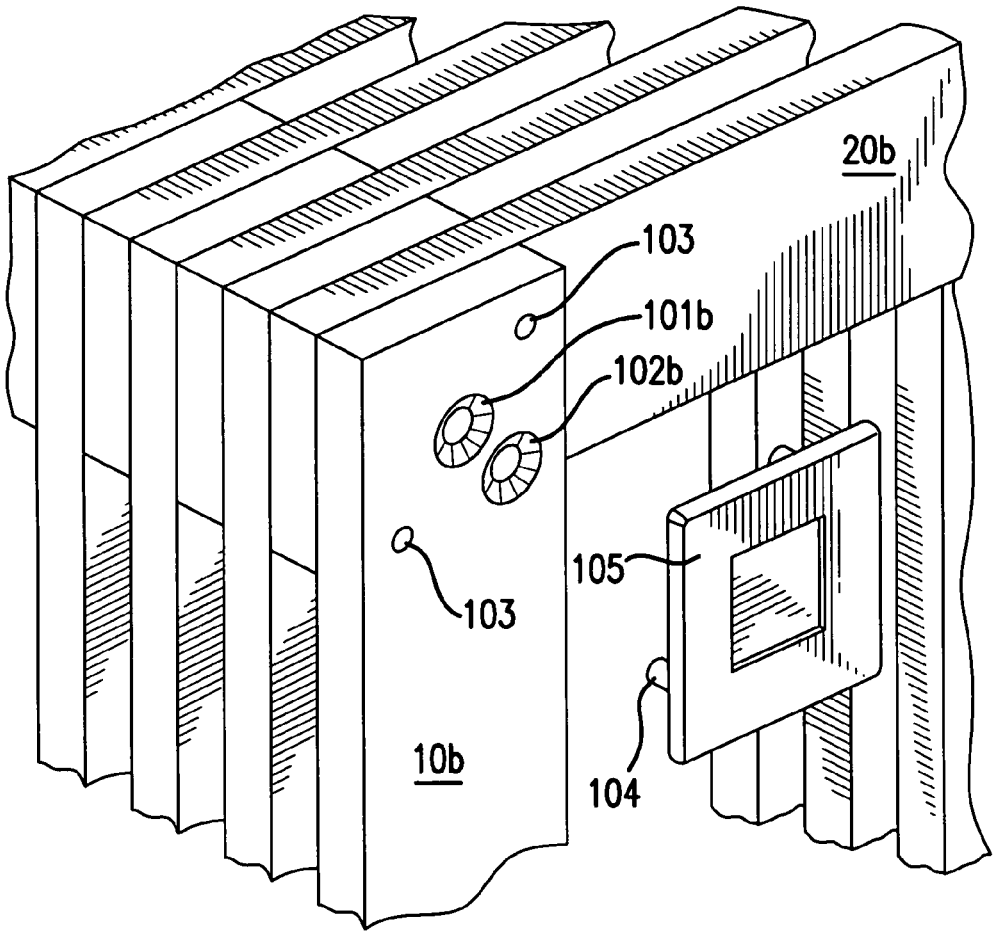
FIG. 6 is an enlarged and exploded sectional view of a different connection that can be used for the rack of FIG. 1.
Figure 7:
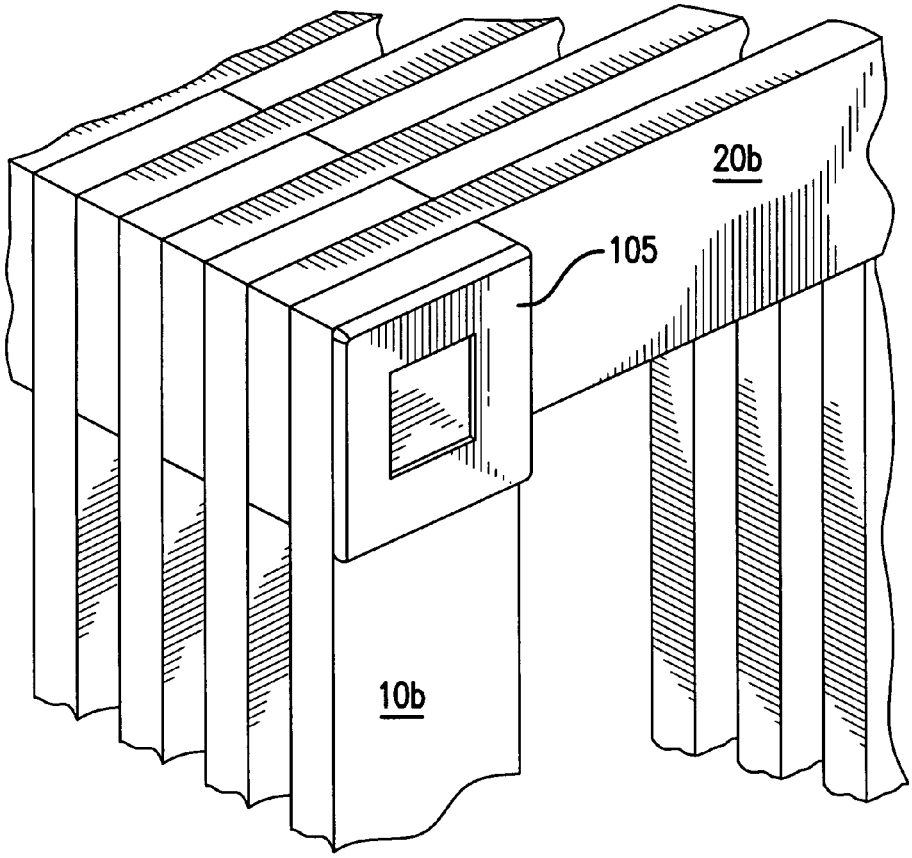
FIG. 7 is an enlarged sectional view of the connection of FIG. 6 shown with the corner pad covering the screw holes.

FIGS. 6 and 7 illustrate a modification that can be made to the connection shown in FIGS. 14. The same numerals are used to designate the same elements in FIGS. 1-4 and 6-7 except that a "b" has been added to the designations in FIGS. 6-7. One of the two connecting holes 102 can be omitted, so that there is only one connecting hole 102*b* that receives one supplementary connecting screw 40 (not shown in FIGS. 6-7). One or more receiving holes 103 are provided on the vertical batten 10*b* at location(s) near the holes 101*b* and 102*b*. Each receiving hole 103 is adapted to receive a corresponding leg 104 on the inner surface of a cover pad 105, so that the cover pad 105 can be used to completely cover the holes 101 *b* and 102*b*, as shown in FIG. 7. A connecting rod 32 is adapted to extend through the hole 101*b*, with the screw 31 secured at the hole 101 *b*. The connecting rod 32 of the screw piece 30 still functions as a pivot axis for the battens 10*b*, 20*b*. The rack in FIGS. 6-7 can be used in exactly the same ways as described above for the rack in FIGS. 1-4, except that the user can additionally install the cover pad 105 after complete deployment of the rack to cover the holes 101*b* and 102*b*.

Thus, the present invention provides a rack for holding articles. The rack can not only be used for storing articles, but it also has an excellent decorative effect that harmonizes with a surrounding environment. Additionally, the triangular relationship formed by two short supplementary connecting screws 40 and the screw piece 30 in the front and the rear of the rack is not only a very simple construction, but also can 30 prevent the rack from turning or becoming crooked. The rack of the present invention can be easily assembled or disassembled, thereby making the storage and transport of the rack very easy.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A rack for holding articles, the rack being pivotable between a folded orientation and a deployed orientation, comprising:

a first set of vertical battens, the first set of vertical battens having at least three battens that includes a front vertical batten and a rear vertical batten;

a first set of horizontal battens, the first set of horizontal battens having at least three battens that includes a front horizontal batten and a rear horizontal batten;

a long connecting screw piece that extends through each batten in the first sets of horizontal and vertical battens with each of the vertical and horizontal battens being positioned directly adjacent to another of the vertical and horizontal battens, the screw piece defining a pivot axis;

a first screw spaced apart from the long connecting screw piece, and having an axis separate but parallel from the pivot axis, the first screw connecting the front battens of the vertical and horizontal battens along the first screw axis;

a second screw spaced apart from the long connecting screw piece, and having an axis separate but parallel from the pivot axis, the second screw connecting the front battens of the vertical and horizontal battens along the second screw axis, with the first and second screws and the long connecting screw piece arranged in a triangular shape on the front vertical batten;

wherein the horizontal and vertical battens are foldable about the pivot axis between the folded orientation and the deployed orientation;

wherein the horizontal battens are pivotally connected to the vertical battens with all the horizontal battens disposed at right angles with all the vertical battens when the rack is in the deployed orientation, and wherein all the horizontal battens are parallel to a support surface on which at least two of the vertical battens are rested upon;

a second set of vertical battens, the second set of vertical battens having at least three battens, with each batten in the second set of vertical battens being parallel to each batten in the first set of vertical battens when the rack is in the deployed orientation;

a second set of horizontal battens, the second set of horizontal battens having at least three battens, with each batten in the second set of horizontal battens being parallel to each batten in the first set of horizontal battens when the rack is in the deployed orientation;

wherein the screw piece comprises:

a connecting rod that passes through all of the battens in the first set of vertical battens and the first set of horizontal battens, the connecting rod having a front end and a rear end, a screw that passes through the front vertical batten and is connected to the front end of the connecting rod; and a screw hat that is provided adjacent the rear vertical batten and is coupled to the rear end of the connecting rod;

wherein each horizontal batten of the first set of horizontal battens is alternated by each vertical batten of the first set of vertical battens; and further including a cover pad that is removably coupled to either a front horizontal batten or a front vertical batten at the location of the screw piece.

* * * * *